US007775189B2

(12) United States Patent
Bejcek et al.

(10) Patent No.: US 7,775,189 B2
(45) Date of Patent: Aug. 17, 2010

(54) FUEL SYSTEM WITH DRAIN UNIT

(75) Inventors: Andrew E. Bejcek, Essexville, MI (US); John C. Woody, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 12/016,325

(22) Filed: Jan. 18, 2008

(65) Prior Publication Data

US 2008/0178850 A1 Jul. 31, 2008

Related U.S. Application Data

(60) Provisional application No. 60/887,469, filed on Jan. 31, 2007.

(51) Int. Cl.
*F02D 41/06* (2006.01)

(52) U.S. Cl. ..... 123/179.16; 123/179.11; 123/179.12

(58) Field of Classification Search ..... 123/179.11–179.16, 510, 437; 261/34.1, 261/35, 51, 52, 69.1; 137/625.44; *F02D 41/06*
See application file for complete search history.

(56) References Cited

U.S. PATENT DOCUMENTS 3,371,658 A * 3/1968 Turner ..... 123/179.11
4,055,609 A * 10/1977 Phelps ..... 261/36.2
4,848,290 A * 7/1989 Miller ..... 123/179.13
4,861,522 A * 8/1989 Gerhardy et al. ..... 261/35
4,936,267 A * 6/1990 Gerhardy et al. ..... 123/179.16
6,213,083 B1 * 4/2001 Winberg ..... 123/198 DB
6,779,503 B2 8/2004 Rado
6,913,250 B2 * 7/2005 Osburg et al. ..... 261/35
7,267,326 B2 * 9/2007 Dedering ..... 261/35
2006/0196749 A1 * 9/2006 Ono et al. ..... 192/48.8

* cited by examiner

*Primary Examiner*—Stephen K Cronin
*Assistant Examiner*—Keith Coleman
(74) *Attorney, Agent, or Firm*—Reising Ethington P.C.

(57) ABSTRACT

A fuel system for a carburetor that supports operation of an engine includes a body with a bore, a fuel source communicated with the bore and from which fuel is supplied to the bore for delivery to the engine, a drain unit and a control. The drain unit is communicated with the fuel source to selectively receive fuel from the fuel source and has a fuel chamber and an actuator operable to vary the volume of the fuel chamber. The control is communicated with the actuator to permit fuel flow from the fuel source to the fuel chamber when the engine is shut down and to cause fuel to flow from the fuel chamber to the fuel source prior to starting the engine.

22 Claims, 3 Drawing Sheets

FUEL SYSTEM WITH DRAIN UNIT

REFERENCE TO COPENDING APPLICATION

This application claims the benefit of U.S. Provisional Patent Application No. 60/887,469 filed on Jan. 31, 2007, which is incorporated herein by reference in its entirety.

FIELD OF THE INVENTION

The present invention relates generally to a carburetor and more particularly to a carburetor including a fuel source.

BACKGROUND OF THE INVENTION

Increasingly strict regulations promulgated by various governmental agencies including the Untied States Environmental Protection Agency and the California Air Resource Board place limits on the hydrocarbon emissions permitted from various small engine devices. One source of hydrocarbon emissions is the float bowl of float bowl type carburetors wherein a supply of fuel resides and is available for delivery from the carburetor to the operating engine. Upon shut down of the engine, the volume of fuel in the fuel bowl can evaporate. Upon evaporation of fuel, a float operated fill valve may permit additional fuel to enter the float bowl from the fuel tank and the evaporation of fuel will continue. So the evaporation from the fuel bowl can be continuous and is not limited to the volume of fuel at any given time in the float bowl. Fuel may also spill from a full float bowl when the device with which the carburetor and engine is used is transported.

SUMMARY OF THE INVENTION

A fuel system for a carburetor that supports operation of an engine includes a body with a bore, a fuel source communicated with the bore and from which fuel is supplied to the bore for delivery to the engine, a drain unit and a control. The drain unit is communicated with the fuel source to selectively receive fuel from the fuel source and has a fuel chamber and an actuator operable to vary the volume of the fuel chamber. The control is communicated with the actuator to permit fuel flow from the fuel source to the fuel chamber when the engine is shut down and to cause fuel to flow from the fuel chamber to the fuel source prior to starting the engine.

When an operator shuts down or otherwise turns off an operating engine, the drain unit permits or causes fuel to flow from the carburetor into the drain unit thereby draining the carburetor of at least some of its fuel. With the carburetor more-or-less empty of liquid fuel, the hydrocarbon emissions therefrom while the engine is at rest, are greatly reduced. Further, the possibility of fuel spilling from the carburetor during moving or transport of the engine is reduced or eliminated.

In one presently preferred implementation, the fuel system is used in conjunction with a small engine driven device, such as a lawnmower. Current lawnmowers include a control such as an operator presence lever adjacent to a handle of the lawnmower. As is common in conventional lawnmowers and the like, the operator presence lever must be actuated to start the engine and maintain operation of the engine. Accordingly, the operator presence lever may be used to provide a control for or to actuate, for example, the drain unit. In at least one implementation, when the operator presence lever is actuated, the drain unit may be arranged to not receive fuel from the carburetor, and when the operator presence lever is not actuated, the drain unit may be arranged to receive fuel from the carburetor. Also, in one implementation, initial actuation of the operator presence lever may cause or initiate an action where fuel is transferred from the drain unit to the carburetor to facilitate starting and operation of the engine.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
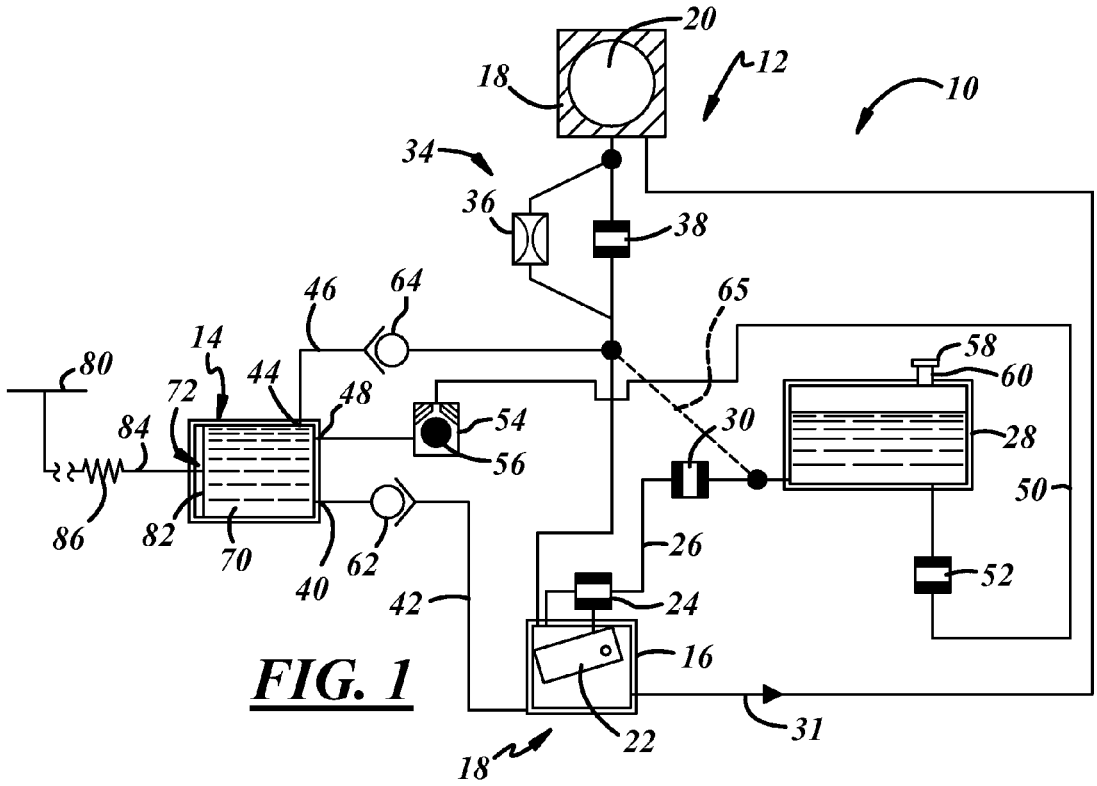
FIG. 1 is a schematic diagram of a fuel system including a float bowl type carburetor with an automatic bowl drain system with the elements of the system shown in their position with the engine stopped.

Referring in more detail to the drawings, FIGS. 1-5 illustrate a fuel system 10 including a charge forming device such as a float bowl carburetor 12 for supplying a combustible charge of fuel and air to support operation of an engine. The fuel system 10 preferably includes a drain unit 14 that may receive liquid fuel from a fuel source such as a float bowl 16 of the carburetor 12 when the engine is shut down, and refill the float bowl 16 when the engine is prepared for starting. Accordingly, the float bowl 16 may be drained when the engine is not running to limit hydrocarbon emissions therefrom, and also prevent fuel leakage or spillage as the engine or device is transported. Also, normal starting and operation of the engine may be facilitated with the return of fuel from the bowl drain unit 14 to the float bowl 16 prior to attempted starting of the engine. The system may be constructed generally as set forth in U.S. patent application Ser. No. 11/135,242, the disclosure of which is incorporated herein by reference in its entirety.

The charge forming device may be a conventional float bowl type carburetor 12 or any other charge forming device that maintains a supply of fuel therein. The carburetor 12 may include a body 18 that defines a fuel and air mixing passage 20 or a venturi bore and has a float bowl 16 in which a supply of fuel is maintained and the level therein controlled by a float mechanism 22, in a known manner. The float mechanism 22 may control a valve 24 to selectively open a fuel line 26 from a fuel tank 28 to the float bowl 16 when the level of fuel in the float bowl 16 is below a threshold level. A fuel shutoff valve 30 may be disposed between the fuel tank 28 and the float bowl 16 to selectively prevent fuel flow from the fuel tank to the float bowl. The shutoff valve 30 may be electrically, mechanically or otherwise actuated to prevent fuel flow from the fuel tank 28 to the float bowl 16 when the engine with which the carburetor is used is not running. This may prevent, for example, fuel from the fuel tank from refilling the float bowl when it is drained or if fuel evaporates therefrom while the engine is not running.

The float bowl 16 may be communicated with the carburetor bore 20 through a main fuel passage 31 (FIG. 1) that provides fuel flow to support engine operation. The carburetor bore 20 may also receive fuel through a priming fuel circuit 34. The priming fuel circuit 34 may communicate with the bore 20 generally at a choke valve side of the bore, or upstream of a venturi commonly provided in carburetor bores. The priming fuel circuit 34 may include a valve 38 such as a thermal compensation valve which may be in parallel with a flow controller 36. The flow controller 36 may be a nozzle and may provide a metered flow of fuel into the carburetor bore 20 from the fuel passage 46 during priming.

The thermal compensation valve 38 may be mechanically or electrically operated to provide a metered fuel flow therethrough as a function of the temperature of the engine to be started, or the valve 38 may be responsive to passage of time, for example, passage of time after a prior shutdown of the engine. For example, when the engine is cold, the thermal compensation valve 38 may permit an increased flow rate of fuel thereto to provide an increased priming fuel charge into the carburetor bore 20 to facilitate starting the engine. When the engine is warmer, a lesser fuel flow rate or amount will be permitted through the thermal compensation valve 38 to provide a lesser charge of priming fuel into the carburetor bore 20. The thermal compensation valve 38 may be a thermostatic wax, a bimetal strip, or any other valve that may be automatically or otherwise controlled to provide a variable flow rate as a function of temperature. For example, the thermal compensation valve 38 could be a solenoid controlled valve actuated by a control system responsive to the temperature. In this manner, priming fuel is provided from the carburetor fuel passage 46 into the carburetor bore 20 through the flow controller 36 and thermal compensation valve 38. While they are shown in parallel and separate fuel flow paths, the flow controller 36 and thermal compensation valve 38 could be in series, or only one or the other of them may be used to control the priming fuel charge.

The bowl drain unit 14 includes a first inlet 40 communicated with the carburetor float bowl 16 through a drain passage 42 and an outlet 44 communicated with the float bowl 16 through the return passage 46 which extends to the float bowl 16. The bowl drain unit 14 may also include a second inlet 48 that is communicated with the fuel tank 28 through a fill passage 50 to permit initial filling of the bowl drain unit 14 when the fuel tank 28 is filled for the first time, or when the fuel tank is filled after the fuel system 10 has been run out of fuel.

A second shutoff valve 52 may be provided at or near the fuel tank 28 to prevent fuel flow from the fuel tank 28 to the bowl drain unit 14 when fuel is not being added to the fuel tank 28. A third shutoff valve 54 may be disposed between the bowl drain unit 14 and the fuel tank 28 to prevent fuel flow from the fuel tank 28 to the bowl drain unit 14 when the bowl drain unit is full of fuel. The third shutoff valve 54 may be a float actuated valve that includes a float 56 buoyant in liquid fuel to close the valve 54 when at least a threshold level of liquid fuel is present in the bowl drain unit 14. The second shutoff valve 52 may be a cap actuated shutoff valve that is closed when a fuel cap 58 is on and closing a fill spout 60 of the fuel tank 28, and open when the cap 58 is removed from the fill spout prior to adding fuel to the fuel tank 28. A drain check valve 62 prevents fluid flow from the bowl drain unit 14 to the float bowl 16 through the drain passage 42. A return check valve 64 prevents fluid flow from the float bowl 16 to the bowl drain unit 14. The return check valve 64 may be biased closed, or otherwise designed to open only when acted upon by a threshold differential pressure across it before it opens to, for example, inhibit or prevent evaporative emissions from escaping through this passage and/or to prevent liquid fuel flow through the valve 64 during transport. As shown by dashed line 65 in FIG. 1, the fuel passage 46 could also be communicated with the fuel tank to pass evaporative emissions (or liquid fuel such as during transport) into the tank rather than into the atmosphere through the carburetor bore 20.

Accordingly, fuel flows from the float bowl 16 to the bowl drain unit 14 and from the bowl drain unit 14 through the return passage 46 and to the float bowl 16 but not in the reverse direction. Also, fuel flows from the fuel tank 28 to the bowl drain unit 14 only when the second shutoff valve 52 is open (e.g. the fuel tank cap 58 is removed from the fuel tank 28) and the third shutoff valve 54 is open (e.g. the bowl drain unit 14 is empty or includes a level or volume of fuel below a threshold level or volume).

The bowl drain unit 14 includes a fuel chamber 70 and an actuator 72 that varies the volume of the fuel chamber 70 such as by moving from a first position defining a first volume of the fuel chamber and a second position defining a second volume of the fuel chamber that is less than the first volume. The actuator 72 may be mechanically or electrically actuated, for example by a cable, a solenoid, a motor or the like. When an operating engine is stopped, the volume of the fuel chamber 70 is increased to receive fuel from the float bowl 16 and thereby drain the float bowl 16. Prior to starting the engine, the actuator 72 decreases the volume of the fuel chamber 70 (such as by moving toward its second position) to discharge fuel from the bowl drain unit 14 and deliver it to the float bowl 16 through the outlet 44 and return passage 46. With fuel returned to the float bowl 16, normal priming and starting of the engine may occur. The actuator 72 may be activated by the operator of an engine when the operator actuates or activates a control or device necessary to start the engine. For example, the operator may activate a control or device, such as pulling a starter rope, or activating an electric start ignition system, to start the engine, and doing so may activate the actuator. These controls may be integrated into one control, and they may be electrical, or mechanical or a combination of both.

Figure 2:
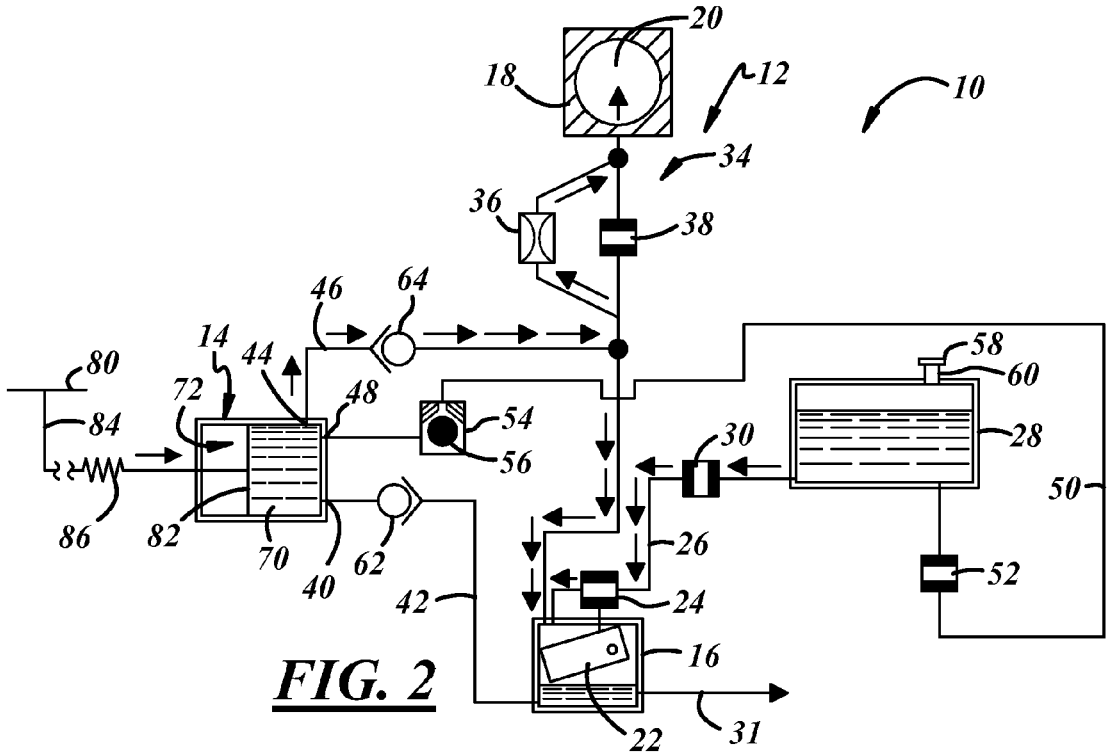
FIG. 2 is a schematic diagram of the fuel system of FIG. 1 with the elements shown in their positions in preparation to start the engine.

Automatic priming of the carburetor 12 may be achieved, for example, by providing the priming fuel circuit 34 in communication with the return fuel passage 46. Accordingly, when fuel is discharged from the bowl drain unit 14 a portion of that fuel may enter the priming fuel circuit 34 and the remainder of the fuel is delivered to the float bowl 16. As previously noted, the amount of fuel that flows through the priming fuel circuit 34 may be moderated or controlled by a thermal compensation valve 38, a nozzle or other flow controller 36, some other valve or flow controller, or a combination of any of these if restriction or moderation of the priming fuel charge is desired. As shown in FIG. 2, when one or more controls are activated in preparation of or during starting the engine, the fuel shutoff valve 30 is preferably moved to its open position. Accordingly, fuel may enter the float bowl 16 from the fuel tank 28 as well as from the bowl drain unit 14.

Figure 3:
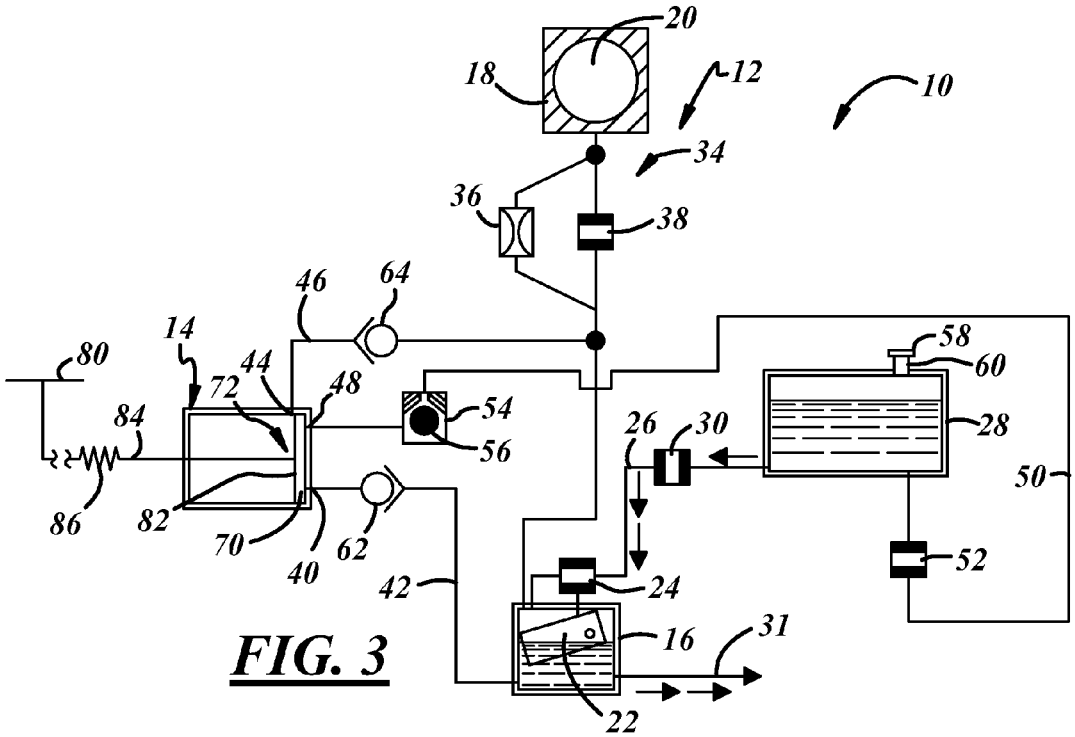
FIG. 3 is schematic diagram of the fuel system with the elements shown in their position as the engine is running.

FIG. 3 illustrates the fuel system 10 while the engine is running. When the engine is running and warm, the thermal compensation valve 38 preferably is closed to prevent or substantially restrict priming fuel flow therethrough. Accordingly, the float bowl 16 is communicated with the carburetor bore 20 through the main fuel passage 31 to provide a metered flow of fuel that is mixed with air in the carburetor bore 20 for delivery to the engine. Make-up fuel is provided from the fuel tank 28 into the float bowl 16 as controlled by the float mechanism 22. Fuel is prevented from flowing from the fuel tank 28 into the bowl drain unit by the second shutoff valve 52 to prevent fuel in the tank 28 from filling the bowl drain unit 14 which would hinder or prohibit subsequent draining of the float bowl 16 into the bowl drain unit 14. Preventing fuel flow from the fuel tank 28 to the bowl drain unit 14 also prevents fuel from flowing through the bowl drain unit 14 (wherein the actuator 72 prevents fuel from accumulating) and into the float bowl 16 providing an undesired additional amount of fuel into the float bowl 16 and overfilling it.

Figure 4:
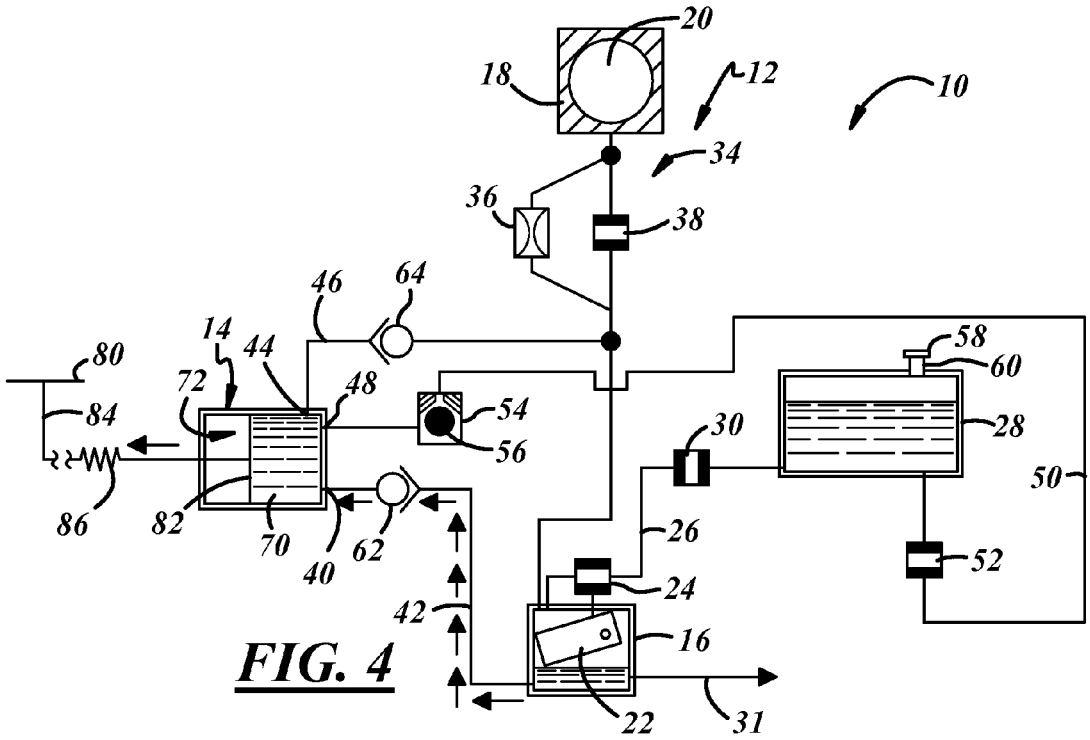
FIG. 4 is a schematic diagram of the fuel system showing the elements in their position as the engine is shut down or stopped.

As shown in FIG. 4, when an operator shuts down or otherwise turns off an operating engine, the bowl drain unit actuator 72 is activated to increase the volume of the bowl drain unit 14 and permit or cause fuel to flow from the float bowl 16 into the bowl drain unit 14 thereby draining the float bowl 16 of at least some of its fuel. The fuel shut off valve 30 is also moved to its closed position to prevent fuel flow between the fuel tank 28 and the float bowl 16. Accordingly, the float bowl 16 remains drained of fuel and is not refilled by the fuel tank 28. With the float bowl 16 empty of liquid fuel, the hydrocarbon emissions therefrom while the engine is at rest, are greatly reduced. Further, the possibility of fuel spilling from the float bowl 16 during moving or transport of the engine is reduced or eliminated.

Figure 5:
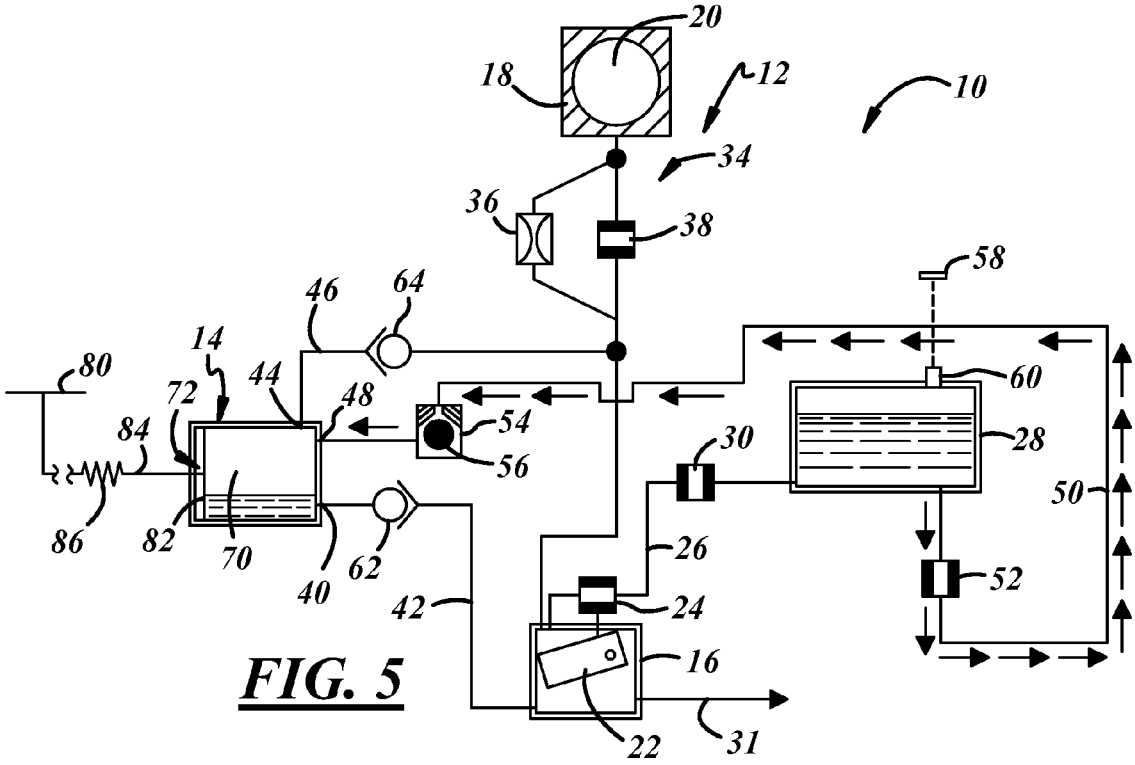
FIG. 5 is a schematic diagram of the fuel system illustrating the elements as the fuel tank is filled.

Because the fuel shut off valve 30 prevents fuel flow between the fuel tank 28 and the float bowl 16 when the engine is stopped, the fill passage 50 is provided to permit fuel from the fuel tank 28 to flow into the fuel system 10 when the fuel system is void of liquid fuel. The fuel system 10 may be void of liquid fuel before fuel is first added to the system, or when fuel has been completely drained of the system by running the engine until all fuel is exhausted from the system and the engine dies. In these situations, when the fuel tank is being filled, the second shutoff valve 52 is open (e.g. when the fuel tank cap 58 is removed to add fuel to the fuel tank 28) and the third shutoff valve 54, which may be float actuated as noted earlier, is also open permitting fuel from the fuel tank 28 to flow into the bowl drain unit 14. It may be desirable to permit this fuel flow to occur under force of gravity and therefore, the bowl drain unit 14 may desirably be positioned lower than at least some portion of the fuel tank 28. As best shown in FIGS. 1 and 5, when the engine is stopped and the fuel system 10 is void of liquid fuel, the actuator 72 preferably is in its first position providing a maximum volume of the fuel chamber 70 in the bowl drain unit 14. Accordingly, fuel from the fuel tank 28 flows into and preferably fills the bowl drain unit 14 to provide a full charge of fuel therein for subsequent delivery to the priming circuit 34 and float bowl 16 upon activation of the actuator 72 prior to starting the engine. When the bowl drain unit 14 is sufficiently full, the third shutoff valve 54 will close terminating fuel flow between the fuel tank 28 and the bowl drain unit 14. The fuel system 10 is now charged with fuel and ready for a subsequent attempt to start the engine and for subsequent engine operation.

In one presently preferred implementation, the fuel system 10 is used in conjunction with a small engine driven device, such as a lawnmower. Current lawnmowers include an operator actuated device or control such as an operator presence lever 80 adjacent to a handle of the lawnmower. As is common in conventional lawnmowers and the like, the operator presence lever 80 must be actuated to start the engine and maintain operation of the engine. This ensures that the operator is at a safe distance from the lawnmower blade and that at least one hand of the operator is on the handle of the lawnmower. Accordingly, the operator presence lever 80 may be used to provide one or more of the controls needed to actuate, for example, one or both of the bowl drain unit actuator 72 and the fuel shut off valve 30.

In such an embodiment, when the operator presence lever 80 is not actuated the actuator 72 is in its first position providing a maximum volume of the bowl drain unit fuel chamber 70, and the fuel shut off valve 30 is closed. Actuation of the operator presence lever 80 moves the actuator 72 to its second position providing a minimum volume of the fuel chamber 70 and expelling liquid fuel therefrom, and opening the fuel shut off valve 30 to permit fuel flow from the fuel tank 28 to the float bowl 16, as shown in FIG. 2. The actuator 72 and fuel shut off valve 30 may be mechanically linked, such as by a cable, or electrically linked and operated by, for example solenoid valves, to each other and/or the operator presence lever 80. Because the operator presence lever 80 must be actuated to start the engine with or without the bowl drain unit 14, the starting procedure of the lawnmower with the bowl drain unit 14 need not be any more complicated than it would be without the bowl drain unit 14. The operator can simply activate the operator presence lever 80 and then pull a starter rope, turn an ignition key, or press an ignition button to start the engine in a generally conventional manner. When the engine is shut down or when the operator presence lever 80 is released, the fuel shut off valve 30 preferably returns to its closed position and the actuator 72 moves or is moved back to its first position providing a maximum volume of the fuel chamber 70 wherein it is set to receive liquid fuel from the float bowl 16. The fuel may be actively drawn or moved by a decreased pressure in the bowl drain unit 14 from the float bowl 16 into the bowl drain unit or may drain under force of gravity, for example.

In one implementation, the actuator 72 includes a diaphragm 82 connected to a cable 84 that is in turn connected to the operator presence lever 80. A spring 86 may be disposed between the diaphragm 82 and the cable 84 or lever 80 to prevent excessive force on the diaphragm 82 when the operator presence lever 80 is activated. The diaphragm 82 may flex or move within the bowl drain unit 14 to vary the volume of its fuel chamber 70. When the diaphragm 82 is moved to the first position (e.g. shown in FIG. 1), increasing the volume of the fuel chamber 70, a negative or reduced pressure may be created in the fuel chamber 70 which causes fuel to flow from the float bowl 16 and into the bowl drain unit 14. When the diaphragm 82 is displaced to its second position (e.g. shown in FIG. 3), it reduces the fuel chamber volume and actively discharges fuel from the bowl drain unit 14. The actuator 72 may be yieldably biased to its first position such that upon release of the lever 80 the diaphragm returns to its first position. Of course, the actuator 72 could otherwise or in addition include any pump, piston, motor or other device suitable to control the volume of the fuel chamber 70.

The fuel shut off valve 30 may be yieldably biased to its closed position and opened against that bias when the operator presence lever 80 is activated. Hence, when the operator presence lever 80 is not activated, the shutoff valve 30 is closed under the force of its biasing mechanism. The valve 38 may be carried by a valve block or otherwise in the carburetor body 18.

The valve 38 may include a solenoid valve that is moveable between first and second positions to alternately permit fuel flow therethrough. The solenoid valve may be a so-called bi-stable solenoid valve that is moved between open and closed positions by applying a signal of a first polarity to open the valve and of a second polarity to close the valve. In this manner, a signal need not be constantly applied to either hold the valve open or hold it closed. Of course, other valves or valve types can be utilized as desired.

Figure 6:
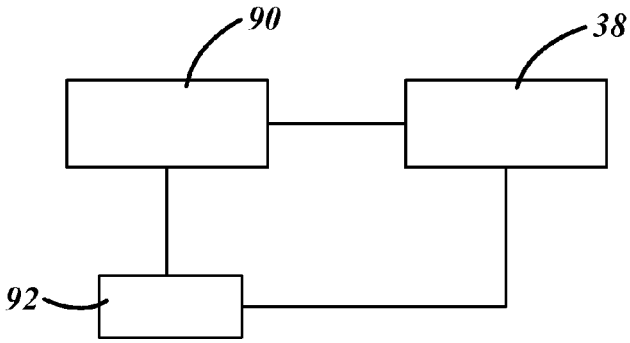
FIG. 6 is a schematic view of a control system for a valve.

As generally shown in FIG. 6, the solenoid valve 38 may be communicated with an ignition module 90 that has an electrical output suitable to drive and control the solenoid valve. In one implementation, the ignition module 90 charges a capacitor or other charge storage member 92 when the engine is started. This may be accomplished by using a charge winding of the ignition module 90 that generates electrical current from a moving magnetic field of the engine fly wheel. After a first duration when the engine is started, the capacitor 92 is momentarily electrically connected to the solenoid valve in the appropriate polarity to move the solenoid valve to its closed position. This may prevent further fuel flow through the valve 38 and into the carburetor bore 20 to end the enriched fuel delivery or priming of the carburetor 12. The first duration may be approximately one minute after the engine is started in at least certain implementations. After this event, the charge winding recharges the capacitor 92 and keeps the capacitor fully charged until the engine is shut down. Thereafter, a second duration after the engine is shut down, the ignition module 90 drives the solenoid valve 38 to its open position to permit a priming fuel flow therethrough upon a subsequent attempted start of the engine. The second duration may be approximately twenty minutes after the engine is shut down or some other duration to ensure that if a warm engine is restarted and a priming fuel charge is not needed, that the solenoid valve 38 remains closed and the additional priming fuel flow is prevented. The time can be varied as needed, and may be controlled by a timer or other control system as desired.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention. For example, without limitations, the fuel system could be used with a charge forming device other than a float bowl type carburetor that includes a fuel supply or fuel source.

The invention claimed is:

1. A fuel system which supports operation of an engine, comprising:

a carburetor having a body with a fuel and air mixing passage for supplying a fuel and air mixture to an operating engine, a float bowl carried by the body, a fuel inlet communicating with the float bowl through an inlet valve opened and closed by a float received in the float bowl and responsive to the level of liquid fuel in the float bowl to open and close the inlet valve, and a main fuel passage communicating with the float bowl and the mixing passage for supplying fuel from the float bowl to the mixing passage at least while the engine is operating;

a drain unit having a variable volume fuel chamber, an actuator operable to vary the volume of the fuel chamber, and the fuel chamber communicating with the float bowl to remove from the float bowl and into the fuel chamber at least a substantial portion of the fuel in the float bowl as the actuator increases the volume of the fuel chamber, and as the actuator decreases the volume of the fuel chamber, fuel in the fuel chamber is supplied to the float bowl;

a shutoff valve upstream of the inlet valve and which, when closed, prevents the flow of fuel from a fuel source to the inlet valve and float bowl and, when open, permits the flow of fuel from the source of fuel to the inlet valve; and a control operably connected with the shutoff valve and the actuator to close the shutoff valve and increase the volume of the fuel chamber to permit fuel flow from the float bowl into the fuel chamber when the engine is shut down and prior to attempted starting of the engine opening the shutoff valve and causing the actuator to decrease the volume of the fuel chamber to supply fuel from the fuel chamber to the float bowl prior to attempted starting of the engine.

2. The fuel system of claim 1 wherein the control is activated prior to attempted starting of the engine and released to shut down the engine.

3. The fuel system of claim 1 which also includes a priming fuel circuit in communication with the fuel chamber of the drain unit and the mixing passage, and configured to control a priming fuel charge delivered to the mixing passage prior to attempted starting of the engine when fuel flows from the fuel chamber to the float bowl.

4. The fuel system of claim 3 wherein the priming fuel circuit includes a priming valve that controls the flow of at least a portion of the priming fuel charge to the mixing passage.

5. The fuel system of claim 4 wherein the priming valve moves between first and second positions as a function of the temperature of the engine to control the flow of at least a portion of the priming fuel charge to the mixing passage.

6. The fuel system of claim 4 wherein the priming valve comprises a solenoid actuated priming valve that is controlled by an ignition module to vary the position of the priming valve as a function of the time of engine operation.

7. The fuel system of claim 6 wherein the solenoid actuated priming valve is moved to a first position after a first duration of engine operation to prevent fuel flow through the priming valve.

8. The fuel system of claim 6 wherein the solenoid actuated priming valve is moved to a second position after a duration of time wherein the engine has not been operating.

9. The fuel system of claim 1 wherein the control includes an operator actuated device that is operably connected to the actuator and when the operator actuated device is actuated the actuator is moved to cause fuel to flow from the fuel chamber to the float bowl.

10. The fuel system of claim 9 wherein the actuator is mechanically driven by movement of the operator actuated device.

11. The fuel system of claim 9 wherein the actuator is electrically operated and movement of the operator actuated device controls communication of an electrical signal to the actuator.

12. The fuel system of claim 11 wherein the actuator includes a solenoid or a motor.

13. The fuel system of claim 1 which also comprises a fuel tank and the shutoff valve is disposed between the fuel tank and the inlet valve to selectively prevent fuel flow to the float bowl when the engine is not operating.

14. The fuel system of claim 13 wherein the control includes an operator actuated device that is mechanically or electrically connected to the shutoff valve so that the shutoff valve is responsive to actuation of the control.

15. A fuel system which supports operation of an engine, comprising:

a carburetor having a body with a fuel and air mixing passage for supplying a fuel and air mixture to an operating engine, a float bowl carried by the body, a fuel inlet communicating with the float bowl through an inlet valve opened and closed by a float received in the float bowl and responsive to the level of liquid fuel in the float bowl to open and close the inlet valve, and a main fuel passage communicating with the float bowl and the mixing passage for supplying fuel from the float bowl to the mixing passage at least while the engine is operating;

a drain unit having a variable volume fuel chamber, an actuator operable to vary the volume of the fuel chamber, and the fuel chamber communicating with the float bowl to remove from the float bowl and into the fuel chamber at least a substantial portion of the fuel in the float bowl as the actuator increases the volume of the fuel chamber, and as the actuator decreases the volume of the fuel chamber, fuel in the fuel chamber is supplied to the float bowl;

a shutoff valve upstream of the inlet valve and which, when closed, prevents the flow of fuel from a fuel source to the inlet valve and float bowl and, when open, permits the flow of fuel from the source of fuel to the inlet valve;

a fuel tank that supplies fuel to the inlet valve of the carburetor;

a second shutoff valve through which fuel flows from the fuel tank into the fuel chamber of the drain unit when the second shutoff valve is open and does not flow from the fuel chamber when the second shutoff valve is closed; and a control operably connected with the shutoff valve and the actuator to close the shutoff valve and increase the volume of the fuel chamber to permit fuel flow from the float bowl into the fuel chamber when the engine is shut down and prior to starting the engine opening the shutoff valve and causing the actuator to decrease the volume of the fuel chamber to supply fuel from the fuel chamber to the float bowl.

16. The fuel system of claim 15 which also includes a third valve disposed between the fuel tank and the fuel chamber of the drain unit and responsive to the level of liquid fuel in the drain unit such that said third valve prevents liquid fuel from entering the fuel chamber of the drain unit when the second shutoff valve is open and the liquid fuel level in the drain unit is above a threshold level and said third valve permits liquid fuel flow from the fuel tank into the fuel chamber of the drain unit when the liquid fuel level in the fuel chamber of the drain unit is below a threshold level.

17. The fuel system of claim 16 wherein said third valve is downstream of the second shutoff valve such that fuel flows through said third valve only when both the second shutoff valve and said third valve are open.

18. The fuel system of claim 1 wherein the actuator is movable between a first position providing a maximum volume of the fuel chamber and a second position providing a minimum volume of the fuel chamber and the actuator is yieldably biased toward its first position.

19. The fuel system of claim 1 wherein the shutoff valve is yieldably biased to its closed position so that the shutoff valve is closed unless the control is actuated to open the shutoff valve.

20. The fuel system of claim 1 wherein the control includes a lever manually movable by an operator from a first position to a second position and manual movement of the lever to the second position is required to start the engine and such movement of the lever to the second position causes a corresponding movement of the actuator to decrease the volume of the fuel chamber, and when the lever is in the first position the engine will not operate and the actuator has increased the volume of the fuel chamber.

21. The fuel system of claim 1 wherein the control includes a lever and movement of the lever from a first position to a second position is required to start the engine and movement of the lever to its second position causes a corresponding movement of the actuator to decrease the volume of the fuel chamber and discharge fuel to the float bowl, and when the lever is in its first position the engine will not operate.

22. A fuel system which supports operation of an engine, comprising:

a carburetor having a body with a fuel and air mixing passage for supplying a fuel and air mixture to an operating engine, a float bowl carried by the body, a fuel inlet communicating with the float bowl through an inlet valve opened and closed by a float received in the float bowl and responsive to the level of liquid fuel in the float bowl to open and close the inlet valve, and a main fuel passage communicating with the float bowl and the mixing passage for supplying fuel from the float bowl to the mixing passage at least while the engine is operating;

a drain unit having a variable volume fuel chamber, an actuator operable to vary the volume of the fuel chamber, and the fuel chamber communicating with the float bowl to withdraw from the float bowl and into the fuel chamber at least a substantial portion of the fuel in the float bowl as the actuator increases the volume of the fuel chamber and as the actuator decreases the volume of the fuel chamber, fuel in the fuel chamber is supplied to the float bowl;

a shutoff valve upstream of the inlet valve which, when closed, prevents the flow of fuel from a fuel source to the inlet valve and float bowl and, when open, permits the flow of fuel from the source of fuel to the inlet valve;

a control operably connected with the shutoff valve and actuator to close the shutoff valve and increase the volume of the fuel chamber to remove fuel from the float bowl while the engine is not operating and prior to attempted starting of the engine opening the shutoff valve and causing the actuator to decrease the volume of the fuel chamber to supply fuel from the fuel chamber to the float bowl prior to attempted starting of the engine; and a priming fuel circuit communicating with the fuel chamber and the mixing passage and configured to control at least a portion of a priming fuel charge delivered to the mixing passage prior to attempted starting of the engine when fuel flows from the fuel chamber to the float bowl.

* * * * *